US008505702B2

(12) United States Patent
Scicluna

(10) Patent No.: US 8,505,702 B2
(45) Date of Patent: Aug. 13, 2013

(54) SHOCK ABSORBING CARRYING DEVICE FOR EXTENDING INTO A PIECE OF LUGGAGE

(75) Inventor: Paul V. Scicluna, Penndel, PA (US)

(73) Assignee: Tumi, Inc., South Plainfield, NJ (US)

( * ) Notice: Subject to any disclaimer, the term of this patent is extended or adjusted under 35 U.S.C. 154(b) by 486 days.

(21) Appl. No.: 12/798,559

(22) Filed: Apr. 7, 2010

(65) Prior Publication Data

US 2011/0247909 A1 Oct. 13, 2011

(51) Int. Cl.
*E05B 1/00* (2006.01)

(52) U.S. Cl.
USPC ..... 190/115; 190/117; 16/114.1; 16/405

(58) Field of Classification Search
USPC ..... 190/115–117; 16/114.1, 405, 407, 16/408, 410, 411
See application file for complete search history.

(56) References Cited

U.S. PATENT DOCUMENTS

| | | | | |
|---|---|---|---|---|
| 1,074,133 | A * | 9/1913 | Neustaedter | 16/405 |
| 1,958,587 | A * | 5/1934 | Michell et al. | 16/405 |
| 1,979,978 | A * | 11/1934 | Martin | 190/115 |
| 2,705,987 | A * | 4/1955 | Schulte | 383/28 |
| 2,806,564 | A | 9/1957 | Pick | |
| 3,447,196 | A * | 6/1969 | Szabo | 16/405 |
| 5,887,927 | A * | 3/1999 | Kurek et al. | 294/158 |
| D461,055 | S | 8/2002 | Szyf | |
| 2001/0034923 | A1 * | 11/2001 | Ho | 16/114.1 |

FOREIGN PATENT DOCUMENTS

| | | |
|---|---|---|
| DE | 35656 | 12/1885 |
| GB | 307287 | 3/1929 |
| GB | 554243 | 6/1943 |

* cited by examiner

*Primary Examiner* — Tri Mai
(74) *Attorney, Agent, or Firm* — Jon Fallon, Esq.

(57) ABSTRACT

A carrying device for extending into a piece of luggage and for absorbing and minimizing shocks when carrying the piece of luggage. The carrying device includes a handle and apparatus for absorbing and minimizing shocks when carrying the piece of luggage by the handle. The apparatus is normally disposed within the piece of luggage so as not to be unaesthetically visible, and is operatively connected to the handle so as to allow for the absorbing and the minimizing of the shocks when carrying the piece of luggage by the handle.

13 Claims, 3 Drawing Sheets

SHOCK ABSORBING CARRYING DEVICE FOR EXTENDING INTO A PIECE OF LUGGAGE

1. BACKGROUND OF THE INVENTION

A. Field of the Invention

The embodiments of the present invention relate to a carrying device for absorbing and minimizing shocks when carrying a piece of luggage or the like, and more particularly, the embodiments of the present invention relate to a carrying device for extending into a piece of luggage or the like and for absorbing and minimizing shocks when carrying the piece of luggage or the like.

B. Description of the Prior Art

Numerous innovations for luggage handles have been provided in the prior art, which will be described below in chronological order to show advancement in the art, and which are incorporated herein by reference thereto. Even though these innovations may be suitable for the individual purposes to which they address, nevertheless, they differ from the present invention in that they do not teach a carrying device for extending into a piece of luggage or the like and for absorbing and minimizing shocks when carrying the piece of luggage or the like.

(1) German Patent Number 35656 to Krumm.

German Patent Number 35656 issued to Krumm on Dec. 17, 1885 teaches a luggage handle with spring tensioner.

(2) Great Britain Patent Application Publication Number 307, 287 to Waterer et al.

Great Britain Patent Application Publication Number 307, 287 published to Waterer et al. on Mar. 7, 1929 teaches a compact stowing handle for portable articles and other purposes and includes a longitudinally flexible handle capable of being brought into an arched position for carrying or normally lying flat; approach and recession of the handle ends is effected by crank action. Each end of the handle is looped over a crank-pin portion of a crank, the outer ends of which are pivoted in a staple-like fitting, and the ends of the handle approaching one another when the handle is raised. A spring strip in the handle is secured at its ends directly to the cranks. Apparatus may be provided for keeping the handle in the raised or flat positions.

(3) Great Britain Patent Application Publication Number 554, 243 to Lee et al.

Great Britain Patent Application Publication Number 554, 243 published to Lee et al. on Jun. 25, 1943 in class 133 teaches a handle provided with a blade spring connected at one or each end to end links slidable in guides and adapted to lie flat against the article when not in use. Apparatus is provided to constrain the end link or links to move as a unit with the handle when assuming the flattened position in such a manner that the connection does not shorten the effective length of the spring. The spring is formed with extensions that are looped around the near ends of the curved links. The folded-back extensions meet or nearly so or even over-lap on the upper or under face of the spring. Tongues integral with the links are disposed between the extensions and the spring proper, with a thrust bar of leather or like material disposed between them and abutting their inner ends. To prevent lateral displacement of the spring and the links, tongues integral with the handle covering are bent around the near ends of the links. Alternatively, this is effected by seating the spring in grooves in the links or by forming the spring with lateral projections embracing the near ends of the links. The single tongue may be replaced by a pair of tongues engaged between the packing strips of the handle. In this form, the spring may have closed end-eyes, with the folded-back extensions being omitted.

(4) U.S. Pat. No. 2,806,564 to Pick et al.

U.S. Pat. No. 2,806,564 issued to Pick et al. on Sep. 17, 1957 in U.S. class 190 and subclass 58 teaches a resilient mounting for coordinating a luggage body and the handle therefor. A handle is for manually carrying the luggage body. A mounting includes a cylindrical casing having a reduced opening at one end. A beaded stud is for attachment to the handle and has a reduced shank portion extending through the opening and terminating in a shoulder apparatus within the casing. A resilient apparatus interposed between the shoulder apparatus and the end of the casing is for cushioning sudden longitudinal shocks between the luggage body and the handle apparatus.

(5) U.S. Pat. No. D461,055 to Szyf.

U.S. Pat. No. D461,055 issued to Szyf on Aug. 6, 2002 in U.S. class D3 and subclass 318 teaches the ornamental design for a handle for a luggage case.

It is apparent that numerous innovations for luggage handles have been provided in the prior art that are adapted to be used. Furthermore, even though these innovations may be suitable for the specific individual purposes to which they address, however, they would not be suitable for the purposes of the embodiments of the present invention as heretofore described, namely, a carrying device for extending into a piece of luggage or the like and for absorbing and minimizing shocks when carrying the piece of luggage or the like.

2. SUMMARY OF THE INVENTION

Thus, an object of the embodiments of the present invention is to provide a carrying device for extending into a piece of luggage or the like and for absorbing and minimizing shocks when carrying the piece of luggage or the like, which avoids the disadvantages of the prior art.

Briefly stated, another object of the embodiments of the present invention is to provide a carrying device for extending into a piece of luggage and for absorbing and minimizing shocks when carrying the piece of luggage. The carrying device includes a handle and apparatus for absorbing and minimizing shocks when carrying the piece of luggage by the handle. The apparatus is normally disposed within the piece of luggage so as not to be unaesthetically visible, and is operatively connected to the handle so as to allow for the absorbing and the minimizing of the shocks when carrying the piece of luggage by the handle.

The novel features considered characteristic of the embodiments of the present invention are set forth in the appended claims. The embodiments of the present invention themselves, however, both as to their construction and their method of operation together with additional objects and advantages thereof will be best understood from the following description of the specific embodiments when read and understood in connection with the accompanying drawing figures.

3. BRIEF DESCRIPTION OF THE DRAWING FIGURES

The figures of the drawing are briefly described as follows:

FIG. 1 is a diagrammatic side elevational view of the carrying device of the embodiments of the present invention extending into a piece of luggage or the like and absorbing and minimizing shocks when carrying the piece of luggage or the like;

4. LIST OF REFERENCE NUMERALS UTILIZED IN THE DRAWING FIGURES

A. General

Figure 1:
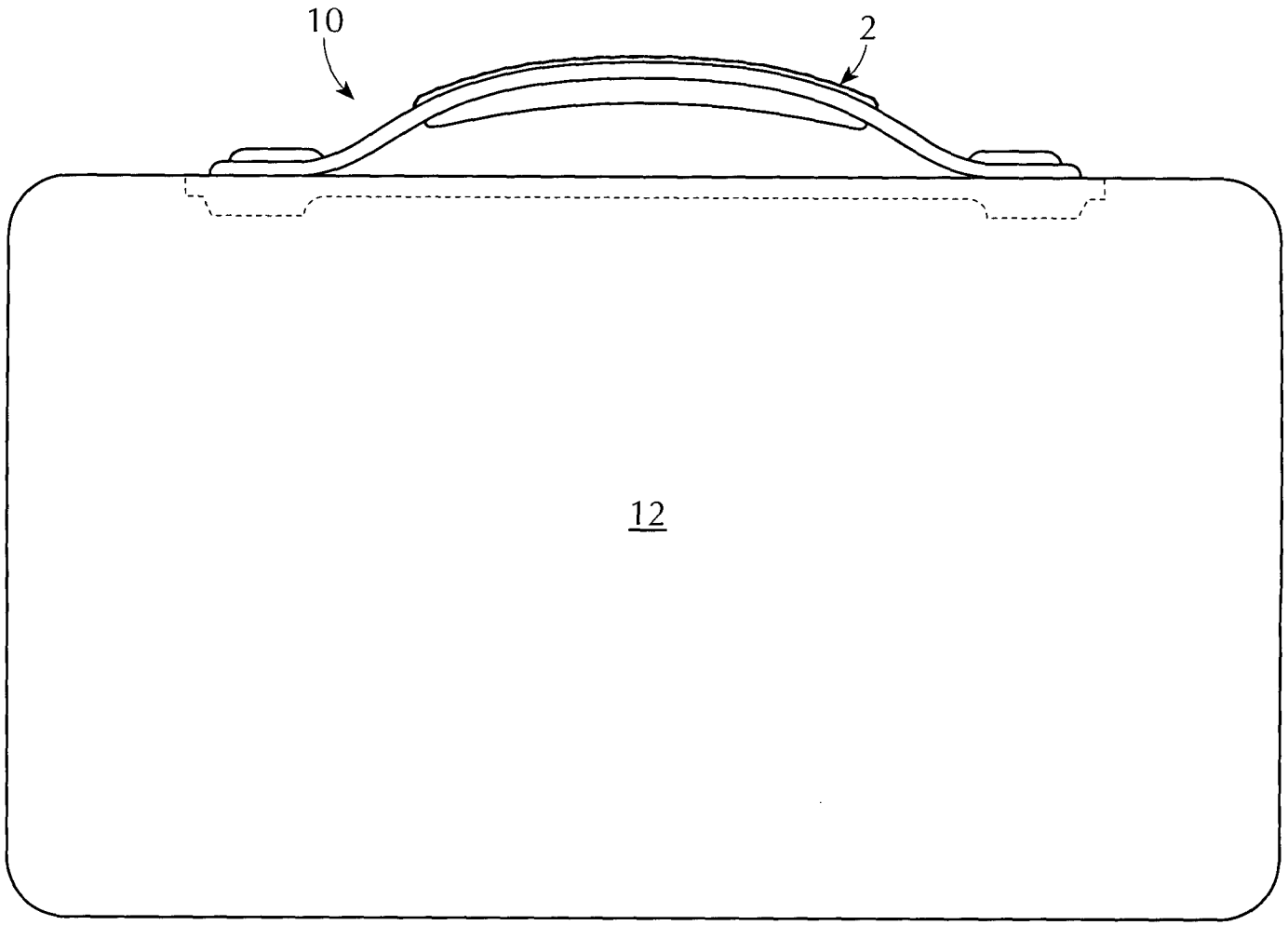

10 carrying device of embodiments of present invention for extending into piece of luggage or like 12 and for absorbing and minimizing shocks when carrying piece of luggage or like 12
12 piece of luggage or like

B. Overall Configuration of Carrying Device 10

14 handle
16 apparatus for absorbing and minimizing shocks when carrying piece of luggage or like 12 by handle 14
18 base plate
20 portion of apparatus 16
22 remaining portion of apparatus 16
24 cover

C. Specific Configuration of Apparatus 16

26 pair of terminal ends of base plate 18 of apparatus 16
28 interior-facing surface of base plate 18 of apparatus 16 for facing into piece of luggage or like 12
30 exterior-facing surface of base plate 18 of apparatus 16 for facing out of piece of luggage or like 12
32 pair of through bores in each terminal end of pair of terminal ends 28 of base plate 18 of apparatus 16
34 terminal ends of handle 14 of apparatus 16
36 pair of posts of each terminal end of pair of terminal ends 34 of handle 14 of apparatus 16
37 pair of terminal ends of pair of posts 36 of each terminal end 34 of handle 14, respectively, of apparatus 16
38 plurality of clips of each terminal end of pair of terminal ends 26 of base plate 18 of apparatus 16
40 pair of axial clips of plurality of clips 38 of each terminal end of pair of terminal ends 26 of base plate 18 of apparatus 16
42 lateral clip of plurality of clips 38 of each terminal end of pair of terminal ends 26 of base plate 18 of apparatus 16
44 pair of leaf springs of apparatus 16
46 bend of each leaf spring of pair of leaf springs 44 of apparatus 16
48 proximal end of each leaf spring of pair of leaf springs 44 of apparatus 16
50 distal end of each leaf spring of pair of leaf springs 44 of apparatus 16

5. DETAILED DESCRIPTION OF THE PREFERRED EMBODIMENTS

A. General

Referring now to the figures, in which like numerals indicate like parts, and particularly to FIG. 1, which is a diagrammatic side elevational view of the carrying device of the embodiments of the present invention extending into a piece of luggage or the like and absorbing and minimizing shocks when carrying the piece of luggage or the like, the carrying device of the embodiments of the present invention is shown generally at 10 for extending into a piece of luggage or the like 12 and for absorbing and minimizing shocks when carrying the piece of luggage or the like 12.

B. The Overall Configuration of the Carrying Device 10

Figure 2:
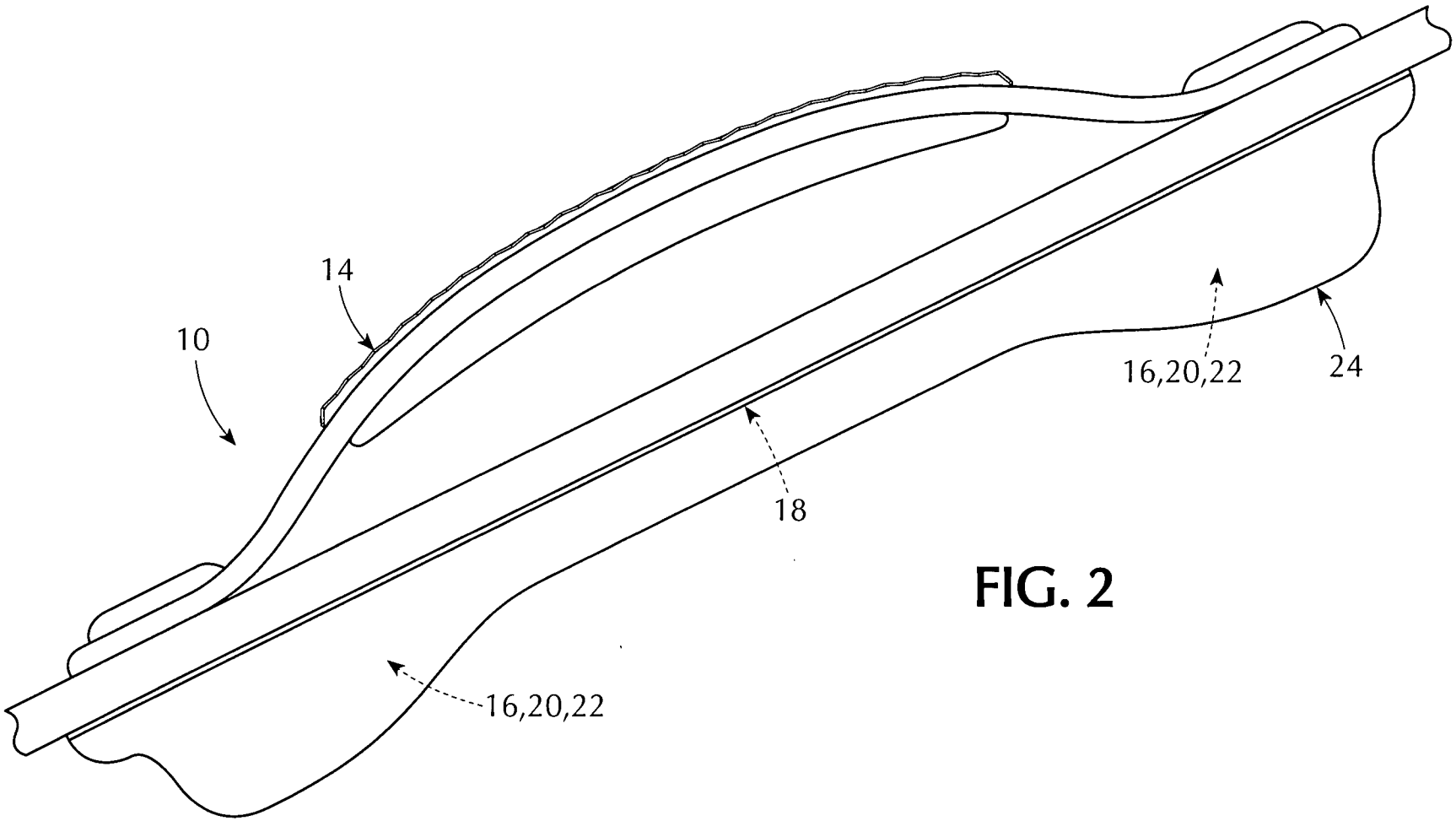
FIG. 2 is an enlarged diagrammatic side elevational view of the carrying device of the embodiments of the present invention identified by ARROW 2 in FIG. 1.

The overall configuration of the carrying device 10 can best be seen in FIG. 2, which is an enlarged diagrammatic side elevational view of the carrying device of the embodiments of the present invention identified by ARROW 2 in FIG. 1, and as such, will be discussed with reference thereto.

The carrying device 10 comprises a handle 14 and apparatus 16 for absorbing and minimizing shocks when carrying the piece of luggage or the like 12 by the handle 14. The apparatus 16 is normally disposed within the piece of luggage or the like 12 so as not to be unaesthetically visible, and is operatively connected to the handle 14 so as to allow for the absorbing and the minimizing of the shocks when carrying the piece of luggage or the like 12 by the handle 14.

The carrying device 10 further, comprises a base plate 18. The base plate 18 movably receives a portion 20 of the apparatus 16, and has movably affixed thereto, a remaining portion 22 of the apparatus 16.

The carrying device 10 further comprises a cover 24. The cover 24 is affixed to the base plate 18 and conceals the apparatus 16 to prevent contents of the piece of luggage or the like 12 from getting caught on the apparatus 16.

C. The Specific Configuration of the Apparatus 16

Figure 3:
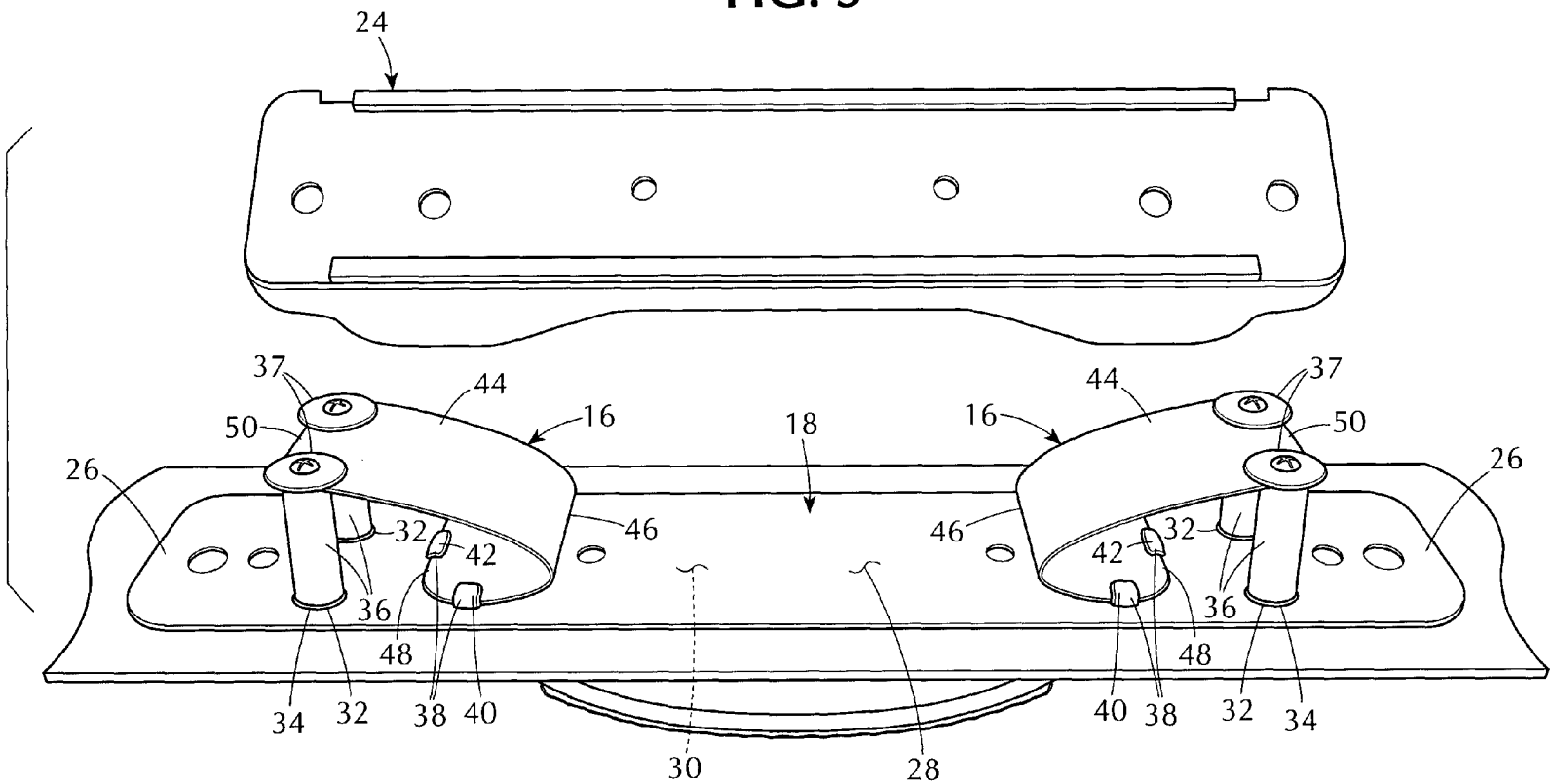
FIG. 3 is a diagrammatic perspective view of the carrying device of the embodiments of the present invention shown in FIG. 2, but with the cover removed to expose the apparatus.

The specific configuration of the apparatus 16 can best be seen in FIG. 3, which is a diagrammatic perspective view of the carrying device of the embodiments of the present invention shown in FIG. 2, but with the cover removed to expose the apparatus, and as such, will be discussed with reference thereto.

The apparatus 16 includes the base plate 18 having a pair of terminal ends 26, an interior-facing surface 28, and an exterior-facing surface 30. The interior-facing surface 28 of the base plate 18 is for facing into the piece of luggage or the like 12, while the exterior-facing surface 30 of the base plate 18 is for facing out of the piece of luggage or the like 12.

The apparatus 16 further includes each terminal end 26 of the base plate 18 having a pair of through bores 32. The pair of through bores 32 in each terminal end 26 of the base plate 18 are disposed side-by-side with each other.

The apparatus 16 further includes the handle 14 having a pair of terminal ends 34. Each terminal end 34 of the handle 14 is bifurcated into a pair of posts 36. The pair of posts 36 of each terminal end 34 of the handle 14 are bent generally normally to the handle 14, pass movably through the pair of through bores 32 in an associated terminal end 26 of the base plate 18, from the exterior-facing surface 30 of the base plate 18 to the interior-facing surface 28 of the base plate 18, to a pair of terminal ends 37, and prevent the handle 14 from rocking sideways.

The apparatus 16 further includes each terminal end 26 of the base plate 18 having a plurality of clips 38. The plurality of clips 38 of each terminal end 26 of the base plate 18 are disposed on the interior-facing surface of the base plate 18 for facing into the piece of luggage or like 12, and are inboard of the pair of through bores 32 in an associated terminal end 26 of the base plate 18.

The plurality of clips 38 of each terminal end 26 of the base plate 18 comprise a pair of axial clips 40 and a lateral clip 42. The pair of axial clips 40 of each terminal end 26 of the base plate 18 oppose each other and open inwardly. The lateral clip 42 of each terminal end 26 of the base plate 18 opens inwardly and is disposed between the pair of axial clips 40 of an associated terminal end 26 of the base plate 18 and the pair of through bores 32 in the associated terminal end 26 of the base plate 18.

The apparatus 16 further includes a pair of leaf springs 44. The pair of leaf springs 44 bias the handle 14 to normally lie flat against the piece of luggage or the like 12.

Each leaf spring 44 is a band of springy material that is bent smoothly towards, itself at a bend 46 forming a generally C-shape, and has a proximal end 48 and a distal end 50. The proximal end 48 of each leaf spring 44 is closer to the bend 46 of an associated leaf spring 44 than the distal end 50 of the associated leaf spring 44 so as to provide proper resiliency.

The proximal end 48 of each leaf spring 44 is axially slidably captured in the plurality of clips 38 of an associated terminal end 26 of the base plate 18 so as to be able to slidably move as each leaf spring 44 flexes, while the distal end 50 of an associated leaf spring 44 is affixed to, to move with, the terminal ends 37 of the pair of posts 36 of an associated terminal end 34 of the handle 14, and in so doing, the pair of leaf springs 44 absorb and the minimize the shocks when carrying the piece of luggage or the like 12 by the handle 14.

The pair of posts 36 of the pair of terminal ends 34 of the handle 14, respectively, are forced out of the luggage or the like 12 as the luggage or the like 12 is carried by the handle 14, but are biased inward by the pair of leaf springs 44 so as to allow the pair of leaf springs 44 to absorb and minimize the shocks when carrying the piece of luggage or the like 12 by the handle 14.

D. Impressions

It will be understood that each of the elements described above or two or more together may also find a useful application in other types of constructions differing from the types described above.

While the embodiments of the present invention have been illustrated and described as embodied in a carrying device for extending into a piece of luggage or the like and for absorbing and minimizing shocks when carrying the piece of luggage or the like, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A carrying device for absorbing shocks when carrying a piece of luggage, comprising:

a handle comprising a pair of terminal ends, each terminal end of the handle comprising a pair of posts bent normally to the handle, the pair of posts adapted to prevent the handle from rocking sideways;

an apparatus operatively connected to the handle, the apparatus adapted to absorb shocks when the piece of luggage is carried by the handle the apparatus adapted to be disposed within the piece of luggage; and a base plate comprising a pair of terminal ends, each end of the pair of terminal ends comprising a pair of through bores; and wherein each pair of posts are adapted to pass movably through each pair of through bores at respective terminal ends.

2. The carrying device of claim 1, wherein the base plate is adapted to movably receive a portion of the apparatus; and wherein the base plate has movably affixed thereto, a remaining portion of the apparatus.

3. The carrying device of claim 2, further comprising a cover affixed to the base plate; and wherein the cover conceals the apparatus and prevents contents of the piece of luggage from getting caught on the apparatus.

4. The carrying device of claim 2, wherein the base plate comprises:

an interior-facing surface adapted to face into the piece of luggage; and an exterior-facing surface adapted to face out of the piece of luggage.

5. The carrying device of claim 4, wherein each through bore of the pair of through bores is disposed side-by-side with each other.

6. The carrying device of claim 1, wherein each terminal end of the base plate comprises a plurality of clips, the plurality of clips disposed on the interior-facing surface of the base plate, the plurality of clips facing into the piece of luggage, and the plurality of clips inboard of the pair of through bores in associated terminal ends of the base plate.

7. The carrying device of claim 6, wherein the plurality of clips comprise:

a pair of axial clips; and a lateral clip.

8. The carrying device of claim 7, wherein the pair of axial clips oppose each other;

wherein the pair of axial clips open inwardly;

wherein the lateral clip opens inwardly; and wherein the lateral clip is disposed between the pair of axial clips and the pair of through bores in an associated terminal end of the base plate.

9. The carrying device of claim 6, wherein the apparatus comprises a pair of leaf springs; and wherein the pair of leaf springs bias the handle to normally lie flat against the piece of luggage.

10. The carrying device of claim 9, wherein each leaf spring is a band of springy material that is bent smoothly towards itself at a bend forming a generally C-shape.

11. The carrying device of claim 10, wherein each leaf spring has a proximal end;

wherein each leaf spring has a distal end; and wherein the proximal end of each leaf spring is closer to the bend of an associated leaf spring than the distal end of the associated leaf spring so as to provide proper resiliency.

12. The carrying device of claim 9, wherein the proximal end of each leaf spring is axially slidably captured in the plurality of clips of an associated terminal end of the base plate so as to be able to slidably move as each leaf spring flexes, while the distal end of an associated leaf spring is affixed to, to move with, the terminal ends of said pair of posts of an associated terminal end of the handle, and in so doing, the pair of leaf springs absorb shocks when carrying the piece of luggage by the handle.

13. The carrying device of claim 9, wherein the pair of posts of the pair of terminal ends of the handle, respectively, are forced out of the luggage as the luggage is carried by the handle, but are biased inward by the pair of leaf springs so as to allow said pair of leaf springs to absorb shocks when carrying the piece of luggage by the handle.

* * * * *